US005170214A

United States Patent [19]

Negoro et al.

[11] Patent Number: 5,170,214

[45] Date of Patent: Dec. 8, 1992

[54] FIXING DEVICE HAVING A CLEANING ELEMENT

[75] Inventors: Ikuo Negoro, Sakado; Masahiro Kita, Tokyo; Tomoyuki Nishikawa, Matsudo, all of Japan

[73] Assignee: Asahi Kogaku Kogyo Kabushiki Kaisha, Tokyo, Japan

[21] Appl. No.: 716,941

[22] Filed: Jun. 18, 1991

[30] Foreign Application Priority Data

Jun. 19, 1990 [JP] Japan ..... 2-160600

[51] Int. Cl.[5] ..... G03G 15/20

[52] U.S. Cl. ..... 355/283; 355/284

[58] Field of Search ..... 355/282, 284, 290, 283; 219/216, 469; 432/60; 118/60, 101

[56] References Cited

U.S. PATENT DOCUMENTS 3,998,584 12/1976 Wada et al. ..... 432/60
4,272,666 6/1981 Collin ..... 219/216
4,393,804 7/1983 Nygard ..... 118/60

FOREIGN PATENT DOCUMENTS 59-113471 6/1984 Japan ..... 355/284
60-8872 1/1985 Japan ..... 355/284
61-238076 10/1986 Japan ..... 355/284
62-89979 4/1987 Japan ..... 355/284
62-145271 6/1987 Japan ..... 355/284

*Primary Examiner*—Joan H. Pendegrass
*Attorney, Agent, or Firm*—Sandler, Greenblum & Bernstein

[57] ABSTRACT

A heat roll fixing device for an electrophotographic image recording apparatus is provided with a cleaning felt extending in the axial direction of the heat roller and arranged to contact the circumferential surface of a heat roller for removing toner thereon with oil being oozed from the cleaning felt and applied to the circumferential surface of the heat roller. In order to evenly spread or absorb the oil, it is particularly applied onto the circumferential surface of the heat roller while it is located at its retracted position when printing operation is started, with the heat roller being controlled to rotate for a predetermined period of time before being shifted to its operable position. Then the rotation is stopped and the heat roller is shifted to the operable position. The rotation of the heat roller is restarted after another predetermined period of time has passed since the required operation of the image recording apparatus.

20 Claims, 6 Drawing Sheets

FIXING DEVICE HAVING A CLEANING ELEMENT

BACKGROUND OF THE INVENTION

The present invention relates to a heat roll fixing device employed in an electrophotographic image recording apparatus.

A so-called electrophotographic image forming process is known in which an evenly charged surface of a photoconductive drum is exposed to light carrying an image data to form a latent image, toner is adhered to the surface of the photoconductive drum to form a toner image, the developed image (toner image) is transferred onto a recording sheet, and the image is fixed on the recording sheet by a fixing device.

Electrophotographic printers have been known utilizing the electrophotographic image forming process described above. Some of these electrophotographic printers are capable of printing an image onto a continuous form recording sheet which has been used in the conventional printers such as a so-called line printer.

A fan-fold sheet is one of the sheets of a web of continuous-form recording sheets which have been used in conventional printers. The fan-fold sheet has feed holes and perforated tear lines, at which the fan-fold sheet is alternately folded, and further can easily be cut into pages.

Generally, in an electrophotographic image recording apparatus such as a copy machine, a heat roll fixing device is used for fixing the toner transferred on the recording sheet. A recording sheet carrying an unfixed toner image is caused to abut against a heated roller (heat roller), whereby the toner forming an image is fused and fixed onto the recording sheet.

The heat roll fixing device is constructed such that a heat roller, to be heated to high temperature, and a press roller are arranged opposite to each other. The recording sheet is nipped between the pair formed by the heat roller and the press roller, thus the recording sheet carrying a toner image is pressed and heated. With this heat roll fixing device, a relatively high heat efficiency can be obtained. It should be noted that, in general, the heat roller is driven to rotate, thereby the recording sheet can be fed by the fixing device.

When the heat roll fixing device is employed in an electrophotographic printer using a continuous-form recording sheet such as a fan-fold sheet, a problem arises. When the recording sheet is nipped between the heat roller and the press roller without being fed, the portion of the recording sheet located at the fixing device may be burnt or blistered by the heat applied by the heat roller.

In order to prevent the above problem, the fixing device is generally constructed such that one of the pair of rollers of the fixing device is retracted when printing is not executed.

Further, in the heat roller fixing device described as above, in order to remove the toner stuck onto the circumferential surface of the heat roller, a cleaner is provided. The cleaner is constructed such that an exfoliation oil such as silicon oil is caused to soak into a fiber member, such as felt, and the cleaner is made to contact the heat roller.

In this case, a further problem arises. Since rotation of the heat roller is stopped when it is from the press roller, the cleaner is kept in contact with the same portion of the heat roller as long as the heat roller is retracted and is not rotated. Then, the silicon oil oozing from the cleaner is partially applied to the circumferential surface of the heat roller. Under this condition, when the printing is restarted and the heat roller is returned its operable position, the oil partially applied onto the circumferential surface of the heat roller is transferred onto the recording sheet, thereby smearing the recording sheet.

SUMMARY OF THE INVENTION

It is therefore an object of the present invention to provide an improved heat roll fixing device capable of preventing the oil, which has oozed from the cleaner and has been partially applied to the circumferential surface of the heat roller, from transferring to a recording sheet.

To accomplish the above object, according to the present invention, a heat roll fixing device for an electrophotographic image recording apparatus is provided. The device includes a heat roller shiftable between a retracted and an operable position, and located at the retracted position when the fixing operation is not being performed. The heat roller is located at the operable position when the fixing operation is performed.

A device for applying oil onto the circumferential surface of the heat roller and a drive mechanism for driving the heat roller to rotate are provided. The fixing device further includes a control device for controlling the drive mechanism in such a fashion that the heat roller is rotated while the heat roller is located at the retracted position. Rotation of the heat roller is stopped before the heat roller is shifted to the operable position and rotation of the heat roller is restarted after the roller is shifted to the operable position.

Optionally, the heat roller can be controlled to rotate for a predetermined period of time when the operation of the image recording apparatus is required and while the heat roller is located at the retracted position. Thus, the oil applied onto the circumferential surface of the heat roller is sufficiently spread so that it is not transferred onto the recording medium.

Further, rotation of the heat roller can be restarted after a predetermined period of time has passed since the operation of the image recording apparatus was performed.

According to another aspect of the invention, there is provided an electrophotographic image recording apparatus employing a heat roll fixing device. The device includes a heat roller that is shiftable between a retracted position and an operable position. The heat roller is located at the retracted position when the fixing operation is not performed and is located at the operable position when the fixing operation is performed.

A cleaner is provided for removing toner from the circumferential surface of the heat roller, wherein exfoliation oil oozes from the cleaner and is applied onto the circumferential surface of the heat roller. The fixing device further includes a drive mechanism that drives the heat roller to rotate and a control device that controls the drive mechanism in such a fashion that the heat roller is rotated while the heat roller is located at the retracted position. The rotation of the heat roller is stopped before the heat roller is shifted to the operable position and the rotation of the heat roller is restarted after the heat roller is shifted to the operable position.

Optionally, the drive mechanism includes a drive source for generating a driving force, a transmission device for transmitting the driving force to the heat roller, and a clutch provided between the transmission device and the drive source so as to temporarily disconnect the drive source from the transmission device.

Further, the electrophotographic image recording apparatus includes a traction device for feeding the recording medium, another (i.e., second) transmission device for transmitting the driving force from the drive source through the tractor device, and another clutch arranged between the first clutch and the second transmission device so as to temporarily disconnect the first clutch from the second transmission device. Thus, the driving force is transmitted from the drive source to the tractor device only when both clutches are engaged, while the second transmission device is disconnected from the drive source when the second clutch is disengaged, even if the first clutch is engaged.

Optionally, the electrophotographic image recording apparatus further includes a rocking mechanism for rocking the heat roller and for shifting the heat roller between the retracted position and the operable position.

Further, the control device controls the first clutch, the second clutch, and the heat roller rocking mechanism in such a manner that the drive source and the transmission device are connected and then disconnected when operation of the image recording apparatus is performed and when the heat roller is located at the retracted position. Thereafter, the heat roller is shifted to the operable position, and the transmission device and the second transmission device are simultaneously connected to the drive source after the heat roller is located at the operable position.

Further, the first clutch is controlled to connect the drive source and the transmission device for a predetermined period of time when the heat roller is located at the retracted position.

Further optionally, the first clutch is controlled to connect the drive source and the transmission device after another (i.e., a second) predetermined period of time has passed since the operation of the image recording apparatus was performed. The second clutch is controlled to connect the first clutch and the second transmission device after another (i.e., the second) predetermined period of time has passed since the operation of the image recording apparatus was required.

According to still yet another aspect of the present invention, a method of preventing oil from transferring onto a recording medium utilized in an electrophotographic image recording apparatus is provided. The apparatus includes a heat roller, a rocking mechanism for moving the heat roller between a retracted position and an operable position and a cleaner member extending in the axial direction of the heat roller and arranged to contact the circumferential surface of the heat roller. Oil oozes from the cleaner member to be applied to the circumferential surface of the heat roller. The method includes driving the heat roller to rotate while the heat roller is located at the retracted position when operation of the image recording apparatus is performed, stopping the rotation of the heat roller when a predetermined period of time has passed since the rotation was started, shifting the heat roller from the retracted position to the operable position, and driving the heat roller to rotate when another predetermine period of time has passed since the operation of the image recording apparatus was performed.

DESCRIPTION OF THE ACCOMPANYING DRAWINGS

DESCRIPTION OF THE EMBODIMENTS

Figure 1:
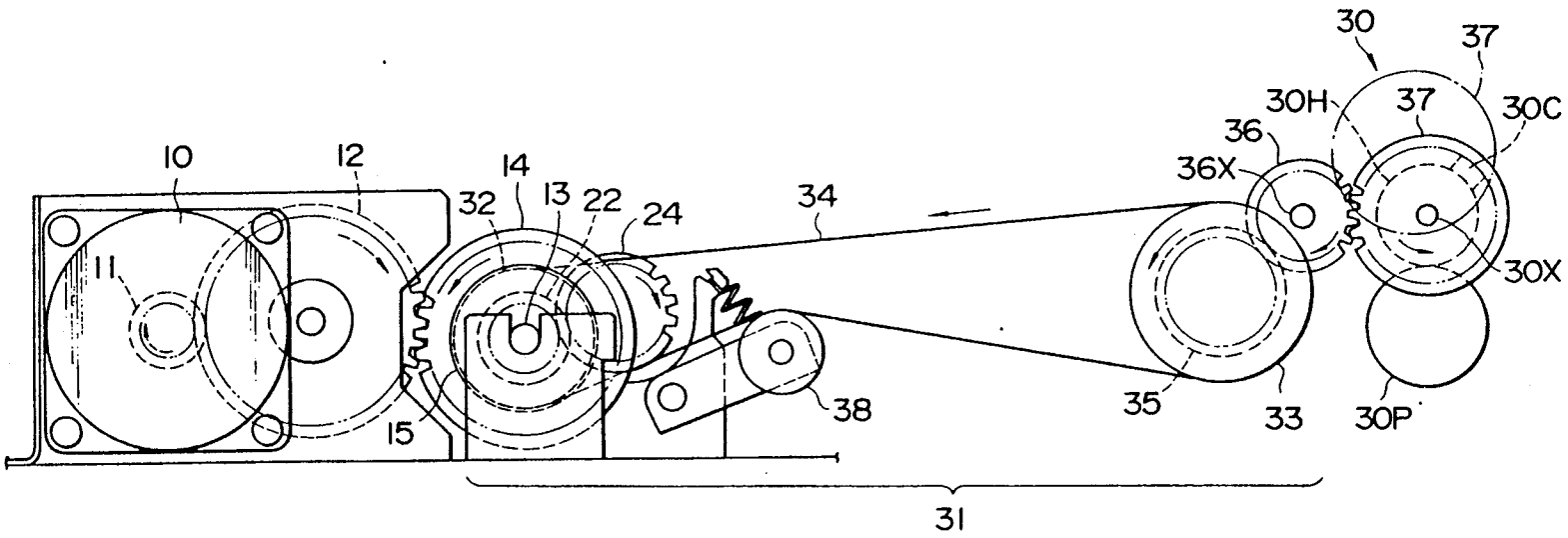
FIG. 1 shows a schematic side view of a driving mechanism for a fixing device.
Figure 3:
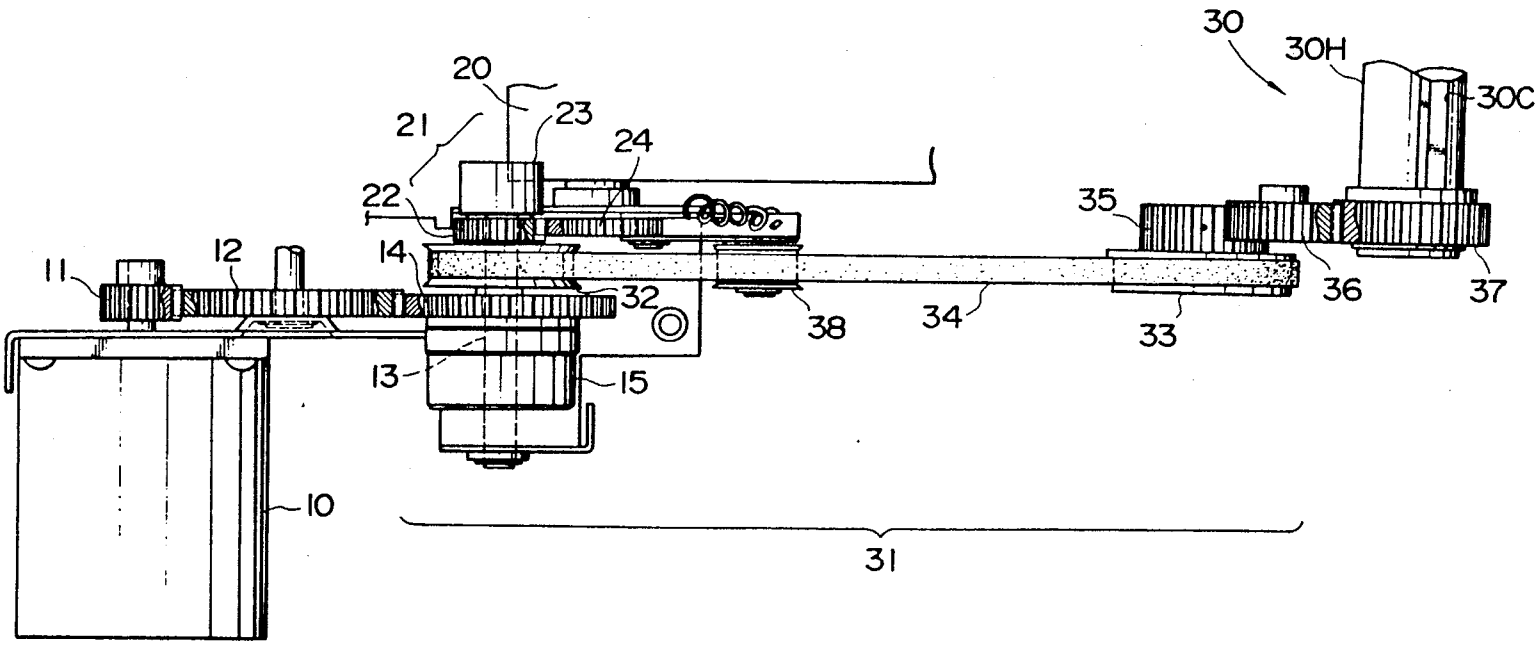
FIG. 3 is a plan view of a driving mechanism of FIG. 1.

FIGS. 1 and 3 show a schematic side view and a plan view of a driving mechanism for driving a fixing device. A motor gear 11 is secured to the spindle of a motor 10 which serves as a drive source. The rotational force generated by the motor 10 is transmitted through a gear 12 to a gear 14 which is connected to a shaft 13. With the shaft 13, a tractor driving system 21 for transmitting the driving force to a tractor 20, and a fixing device driving system 31 for transmitting the driving force to a fixing device 30 are mechanically and independently connected. The tractor 20 is driven to feed a recording sheet.

The gear 14 is connected to the shaft 13 by means of an electromagnetic clutch 15 which serves as a first clutch means. The driving force of the motor 10 is transmitted to the shaft 13 when the clutch 15 is engaged so that the gear 14 and the shaft 13 is connected, while if the clutch 15 is disengaged, the gear 14 is idly driven and the driving force is not transmitted from the gear 14 to the shaft 13. In other words, by engaging/disengaging the clutch 15, the driving force to both the tractor driving system 21 and the fixing device driving system 31 is connected/disconnected simultaneously.

A timing pulley 32 for transmitting the driving force to the fixing device driving system 31 is secured to the shaft 13 such that the timing pulley 32 can not relatively rotate with respect to the shaft 13. Further, a tractor gear 22 of the tractor driving system 21 is connected to the shaft 13 via a spring clutch 23 which serves as a second clutch means. If the spring clutch 23 is engaged so that the tractor gear 22 is connected to the shaft 13, the driving force is transmitted from a tractor gear 22 to a gear 24, thereby the driving force is transmitted to the tractor 20. If the spring clutch 23 is disengaged and the tractor gear 22 is disconnected from the shaft 13, the shaft 13 is idly rotated. Thus, the driving force is not transmitted to the tractor 20.

The fixing device driving system 31 is constructed as follows. A timing belt 34 is provided between the timing pulley 32 and another pulley 33 which is arranged on the fixing device side with respect to the timing pulley 32. A pulley gear 35 is integrally and coaxially composed on the pulley 33 so that the pulley 33 is unable to rotate relative to the pulley 33. The pulley gear 35 meshes with an idle gear 36. The idle gear 36 meshes with a heat roll gear 37 which is provided on an end side of the heat roller 30H of the fixing device 30. Thus the driving force is finally transmitted to the heat roller 30H. It should be noted that a pulley 38 is a tension pulley 38 for applying a predetermined tension to the timing belt 34.

The fixing device is constructed such that a press roller 30P is rotatably arranged below the heat roller 30H, both rollers 30P and 30H being urged to be pressed against each other by a predetermined pressing force. Further, the heat roller 30H is constructed to be rockable about a shaft 36X of the idle gear 36, and is driven to rock by a well-known rocking mechanism 3.

Figure 2A:
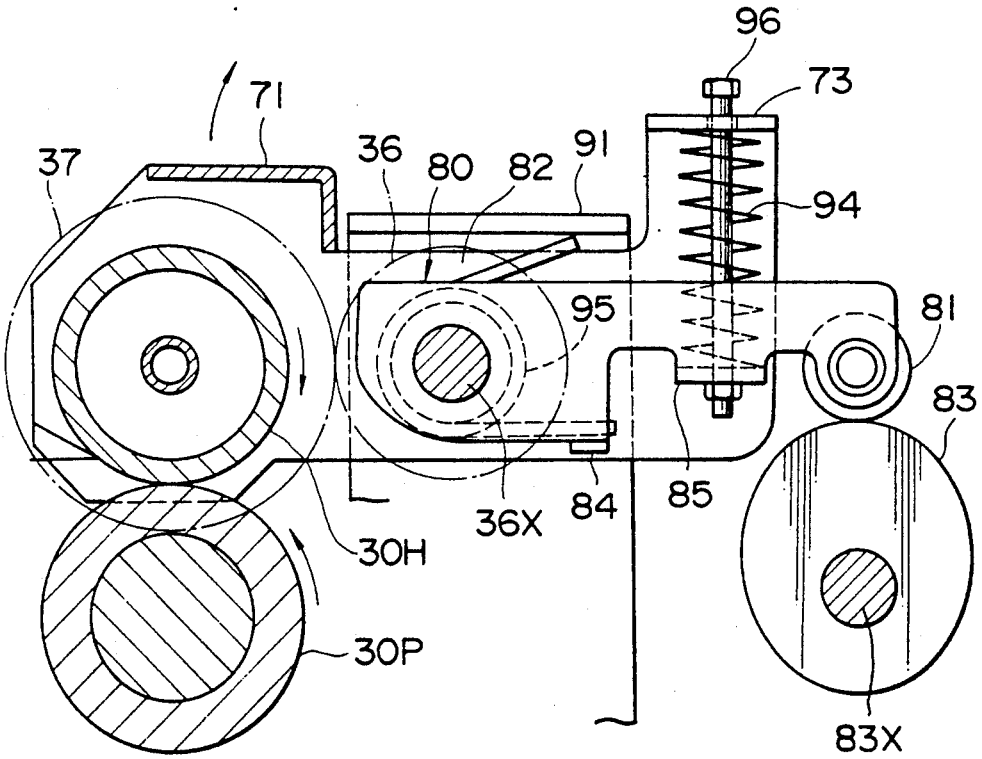
FIGS. 2A and 2B show a rocking mechanism for rocking a heat roller of the fixing device.
Figure 2B:
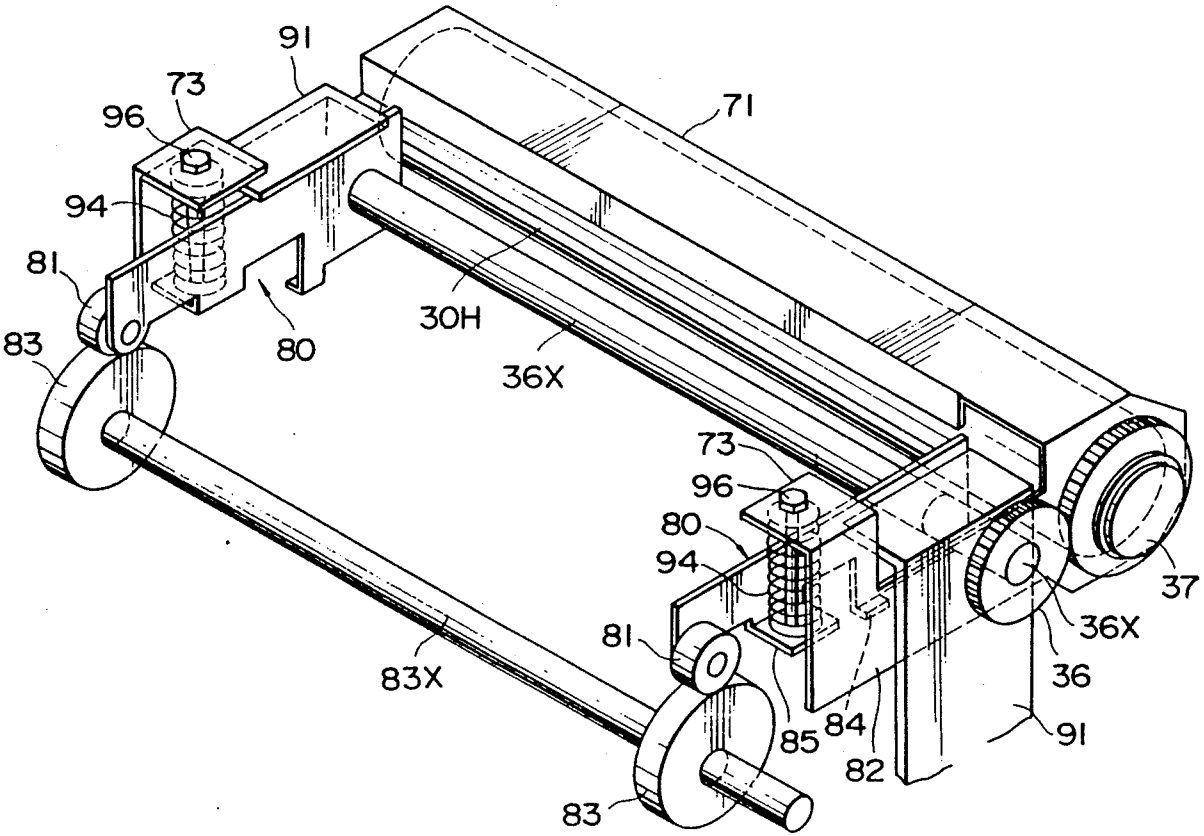

FIG. 2A is a side view of the heat roll fixing unit in an operating state, and FIG. 2B is a schematic perspective view of a heat roll fixing unit employing the heat roller rocking mechanism 3.

The heat roller 30H is accommodated within a heat roll holder 82 which is supported by a lever 80 arranged to be swingably rockable in upward and downward direction in accordance with movement of a cam follower 81. The cam follower 81 is driven to be vertically moved as cam 83 rotates. The cam 83 is connected to a not shown drive source through a shaft 83X, which is driven to be rotated.

The lever 80 is rockably mounted on a chassis 91 by means of the shaft 36X substantially at the center in the lengthwise direction thereof, and has the cam follower 81 at one side end thereof. A torsion spring 95 is arranged between the lever 80 and the chassis 91 in such a fashion that a contact portion 84 formed on the lever 80 is moved downwardly. Accordingly, the lever 80 is downwardly biased, and then the cam 83 and the cam follower 81 are brought into contact with each other.

Springs 94 are interposed between a spring receiving portion 85 formed on each lever 80 and a corresponding one of the spring receivers 73 provided on the heat roll holder 82. Further, a pair of rock regulation screws 96 are provided within the springs 94, 94, so that an angle formed by the each lever 80 and the heat roll holder 82 is regulated so as to be less than a predetermined value.

As the cam 83 rotates, the springs 94 and 94 are compressed and the heat roll holder 82 is downwardly rocked about the shaft 36X, thereby the rollers 30H, 30P are maintained in contact with each other. Further, the heat roll holder 82 is not moved further when the pressure force generated between the rollers 30H and 30P becomes the predetermined value determined by the springs 94 and 94, thus the lever 80 is only rocked about the shaft 36X.

A cleaning felt 30C acting as a cleaning means for the heat roller 30H is provided such that the cleaning felt 30C extends in the axial direction of the heat roller 30H and contacts the circumferential surface of the heat roller 30H (refer to FIG. 3).

With the fixing device driving mechanism constructed as above, the driving force generated by the motor 10 is transmitted to the shaft 13, and the rotational force of the shaft 13 is transmitted through the tractor driving system 21 and fixing device driving system 31 to the tractor 20 and the fixing device 30, respectively. It should be noted that, by operating the electromagnetic clutch 15 and the spring clutch 23, the fixing device 30 can be operated (i.e., the heat roller 30H can be rotated) independently of the tractor 20.

If only the electromagnetic clutch 15 is engaged and the spring clutch 23 is disengaged, the driving force is transmitted only to the fixing device 30. If both the electromagnetic clutch 15 and the spring clutch 23 are engaged, the fixing device 30 and the tractor 20 are driven synchronously.

Figure 4:
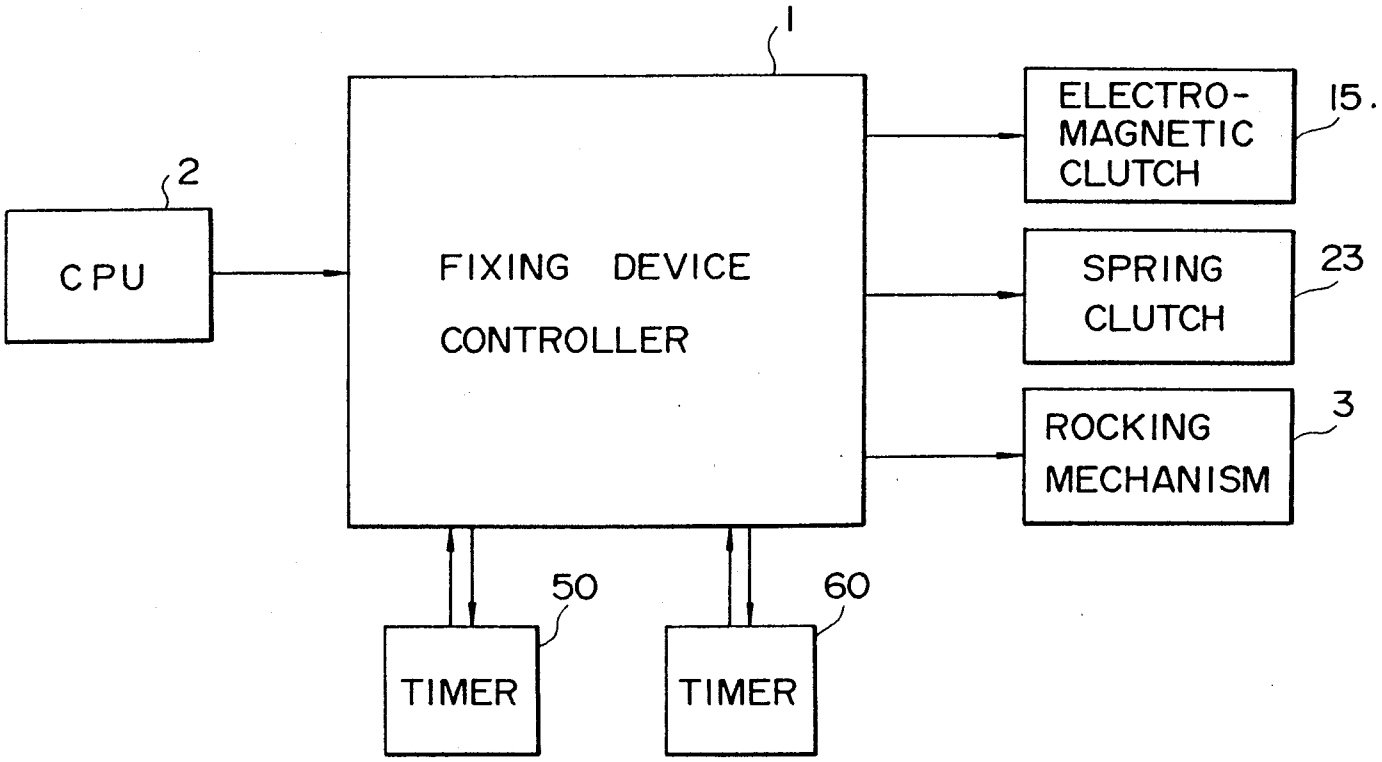
FIG. 4 is a block diagram illustrating the control system of the driving mechanism.

FIG. 4 shows a block diagram of a control system for controlling the fixing device driving mechanism 31.

A CPU (central processing unit) 2 of the electrophotographic printer transmits the operational requirement to a fixing device controller 1. The fixing device controller 1 controls the operation of the electromagnetic clutch 15 and the spring clutch 23 as well as a heat roller rocking mechanism 39 for shifting the heat roller 30H between the retracted position and the operable position in accordance with the operational requirement inputted from the CPU. Further, timers 50 and 60 are connected with the fixing device controller 1 for measuring periods of time "T" and "t", respectively, details of which will be described later.

Figure 5:
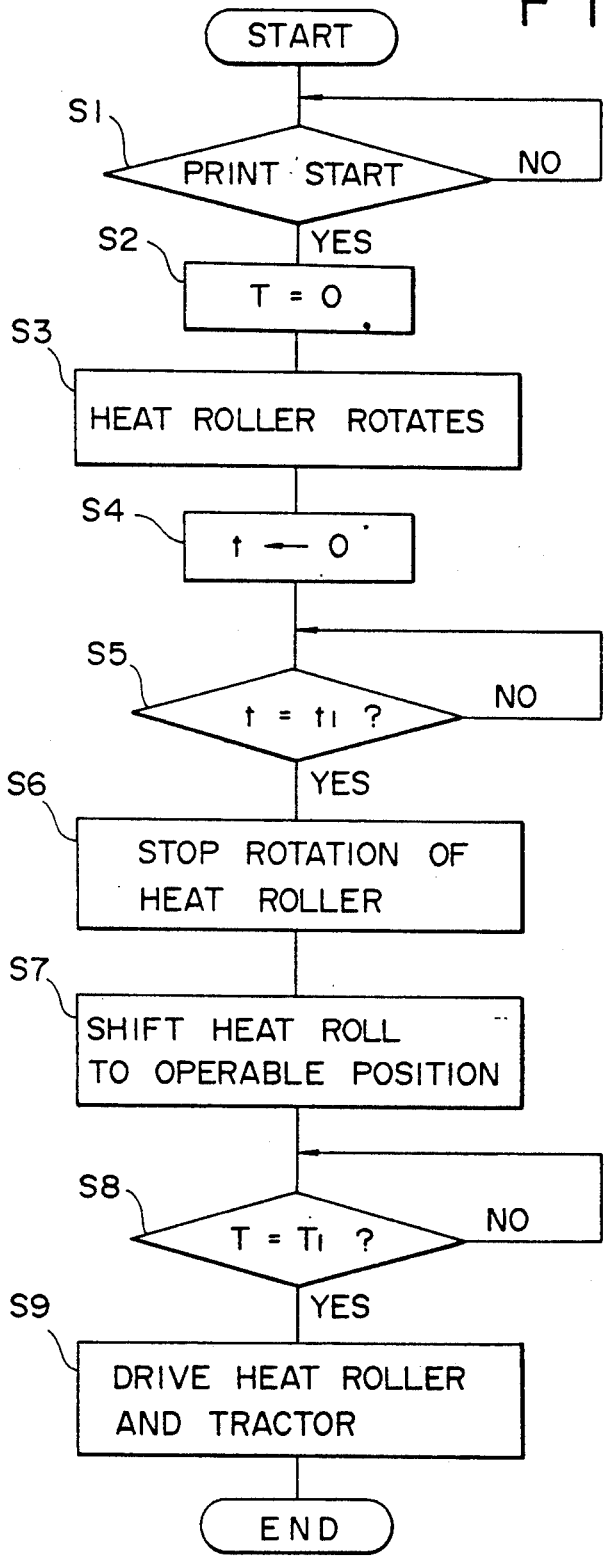
FIG. 5 is a flowchart illustrating the control of the driving system.

FIG. 5 is a flowchart illustrating the control operation of the fixing device controller 1 for controlling the operation of the electromagnetic clutch 15 and the spring clutch 23, and the heat roller rocking mechanism 39 when the fixing operation starts.

When the fixing device is in a stand-by state, the heat roller 30H is located at its retracted position, i.e., the heat roller 30H is released from the press roller 30P. Further, the electromagnetic clutch 15 and the spring clutch 23 are disengaged so that neither the tractor 20 nor the fixing device driving system 31 is mechanically connected to the motor 10.

When the print start signal is inputted form the CPU 2, the timer 50 for measuring the period of time "T" after the print start signal was inputted is reset, the electromagnetic clutch 15 is engaged and the heat roller 30H is driven to rotate, and the timer 60 for measuring the period of time "t" after the heat roller 30H was started to rotate is reset in steps S1 through S4.

After a predetermined period of time $t_1$ has passed, the electromagnetic clutch 15 is disengaged and the rotation of the heat roller 30H is stopped, and the heat roller rocking mechanism 39 is operated so that the heat roller 30H is located at its operable position, i.e., the position at which the heat roller 30H is pressed against the press roller 30P in steps S5 through S7. The predetermined period of time $t_1$ is determined in such a fashion that within the predetermined period $t_1$, the portion of the circumferential surface of the heat roller 30H which contacts the cleaning felt 30C when the heat roller 30H is located at the retracted position passes a position at which the circumferential surface of the heat roller 30H contacts the recording sheet when the heat roller 30H is located its operable position.

In step S8, it is examined whether a predetermined period of time $T_1$ has passed or not after the print start signal is inputted. The period of time $T_1$ is the period in which the leading edge of an image forming area of the circumferential surface of the photoconductive drum reaches the transfer position after the print start signal is inputted. In other words, the leading edge of the toner image formed on the photoconductive drum reaches the transfer position after the predetermined period $T_1$ has passed since the print start signal is inputted. By referring to this period $T_1$, the recording sheet can be fed synchronously with the rotation of the photoconductive drum.

Described as above, by rotating the heat roller 30H for a predetermined period of time prior to the fixing operation, oil which oozes from the cleaning felt 30C and is partially applied onto the circumferential surface of the heat roller 30H is evenly spread or absorbed by the cleaning felt 30C. Thus transfer of the oil partially applied on the heat roller 30H to the recording sheet when the fixing operation is restarted, is prevented.

The present disclosure relates to a subject matter contained in Japanese Patent Application No. HEI 2-160600 (filed on Jun. 19, 1990) which is expressly incorporated herein by reference in its entirety.

What is claimed is:

1. A fixing device for an electrophotographic image recording apparatus comprising:

a heat roller, said heat roller being shiftable between a retracted position and an operable position, said heat roller being located at said retracted position when a fixing operation is unexecuted, said heat roller being located at said operable position when the fixing operation is executed;

means for applying oil onto the circumferential surface of said heat roller, said means for applying oil being in constant contact with said circumferential surface of said heat roller; and drive means for driving said heat roller to rotate, said fixing device further comprising:

control means for controlling said drive means in such a fashion that said heat roller is rotated while said heat roller is located at said retracted position, the rotation of said heat roller being stopped before said heat roller is shifted to said operable position, the rotation of said heat roller being restarted after said heat roller is shifted to said operable position.

2. The fixing device according to claim 1, wherein said heat roller is controlled to rotate for a predetermined period of time when the operation of said image recording apparatus is executed and when said heat roller is located at said retracted position.

3. The fixing device according to claim 1, wherein the rotation of said heat roller is restarted after a predetermined period of time has passed since the operation of said image recording apparatus.

4. A fixing device for an electrophotographic image recording apparatus comprising a heat roller, a press roller, drive means for driving said heat roller to rotate, and means for feeding exfoliation oil onto the circumferential surface of said heat roller, said means for feeding exfoliation oil being in constant contact with said circumferential surface of said heat roller, said heat roller and said press roller being pressed against each other when operated, and being apart from each other when not operated, said fixing device further comprising:

control means for controlling said drive means in such a fashion that said heat roller is rotated and then stopped before said heat roller and said press roller are pressed against each other for operation, the rotation of said heat roller being restarted after said heat roller and press roller are pressed against each other.

5. The fixing device according to claim 4, wherein said heat roller is controlled to rotate for a predetermined period of time before said heat roller and said press roller are pressed against each other.

6. The fixing device according to claim 4, wherein the rotation of said heat roller is restarted after a predetermined period of time has passed since the operation of said image recording apparatus.

7. An electrophotographic image recording apparatus employing a heat roll fixing device, comprising:

a heat roller, said heat roller being shiftable between a retracted position and an operable position, said heat roller being located at said retracted position when a fixing operation is unexecuted, said heat roller being located at said operable position when the fixing operation is executed; and cleaner means for removing toner from the circumferential surface of said heat roller, said cleaner means being in constant contact with said circumferential surface of said heat roller, wherein an exfoliation oil is oozed from said cleaner means, and applied onto the circumferential surface of said heat roller, said fixing device further comprising:

drive means for driving said heat roller to rotate; and control means for controlling said drive means in such a fashion that said heat roller is rotated while said heat roller is located at said retracted position, the rotation of said heat roller being stopped before said heat roller is shifted to said operable position, the rotation of said heat roller being restarted after said heat roller is shifted to said operable position.

8. The electrophotographic image recording apparatus according to claim 7, wherein said heat roller is controlled to rotate for a predetermined period of time when the operation of said image recording apparatus is executed and when said heat roller is located at said retracted position.

9. The electrophotographic image recording apparatus according to claim 7, wherein the rotation of said heat roller is restarted after a predetermined period of time has passed since the operation of said image recording apparatus.

10. The electrophotographic image recording apparatus according to claim 7, wherein said drive means comprises:

a drive source for generating driving force;

transmission means for transmitting the driving force to said heat roller; and clutch means provided between said transmission means and said drive source so as to temporarily disconnect said drive source from said transmission means.

11. The electrophotographic image recording apparatus according to claim 10, which further comprises:

tractor means for feeding said recording medium;

second transmission means for transmitting the driving force from said drive source to said tractor means; and second clutch means arranged between said clutch means and said second transmission means so as to temporarily disconnect said clutch means from said second transmitting means, whereby the driving force is transmitted from said drive source to said tractor means only when both said clutch means and said second clutch means are engaged, while said second transmission means is disconnected from said drive source when said second clutch means is disengage even if said clutch means is engaged.

12. The electrophotographic image recording apparatus according to claim 11, wherein said control means controls said clutch means and said second clutch means in such a manner that said drive source and said transmission means are connected and then disconnected when the operation of said image recording apparatus is executed and when said heat roller is located at said retracted position, and that said transmission means and said second transmission means are simultaneously connected to said drive source after said heat roller is located at said operable position.

13. The electrophotographic image recording apparatus according to claim 12, wherein said clutch means is controlled to connect said drive source and said transmission means for a predetermined period of time when said heat roller is located at said retracted position.

14. The electrophotographic image recording apparatus according to claim 13, wherein said clutch means is controlled to connect said drive source and said transmission means after a second predetermined period of time has passed since the operation of said image recording apparatus was executed, and wherein said second clutch means is controlled to connect said clutch means and said second transmission means after said second predetermined period of time has passed since the operation of said image recording apparatus.

15. The electrophotographic image recording apparatus according to claim 11, which further comprises a rocking mechanism for rocking said heat roller so to be shifted between said retracted position and said operable position.

16. The electrophotographic image recording apparatus according to claim 15, wherein said control means controls said clutch means, said second clutch means, and said heat roller rocking mechanism in such a manner that said drive source and said transmission means are connected and then disconnected when the operation of said image recording apparatus is executed and when said heat roller is located at said retracted position, thereafter said heat roller is shifted to said operable position, and that said transmission means and said second transmission means are simultaneously connected to said drive source after said heat roller is located at said operable position.

17. The electrophotographic image recording apparatus according to claim 16, wherein said clutch means is controlled to connect said drive source and said transmission means for a predetermined period of time when said heat roller is located at said retracted position.

18. The electrophotographic image recording apparatus according to claim 17, wherein said clutch means is controlled to connect said drive source and said transmission means after a second predetermined period of time has passed since the operation of said image recording apparatus and wherein said second clutch means is controlled to connect said clutch means and said second transmission means after said second predetermined period of time has passed since the operation of said image recording apparatus.

19. A method of controlling rotation of a heat roller of a fixing device employed in an electrophotographic printer, said fixing device being provided with a cleaner being in constant contact with the circumferential surface of said heat roller, oil being oozed from said cleaner and applied onto the circumferential surface of said heat roller, said heat roller being shiftable between a retracted position and an operable position, said method comprising steps of:

driving said heat roller, while located at said retracted position, to rotate for a predetermined period of time when the operation of said image recording apparatus is executed;

stopping rotation of said heat roller before said heat roller is shifted to said operable position; and restarting the rotation of said heat roller after said heat roller has been shifted to said operable position.

20. A method of preventing oil transferring to a recording medium utilized in an electrophotographic image recording apparatus, wherein said apparatus comprises a heat roller, a rocking mechanism for moving said heat roller between a retracted position and an operable position, a cleaner member extending in the axial direction of said heat roller and arranged to be in constant contact with the circumferential surface of said heat roller, oil being oozed from said cleaner member and applied to the circumferential surface of said heat roller, said method comprising steps of:

driving said heat roller to rotate while said heat roller is located at said retracted position when the operation of said image recording apparatus is required;

stopping the rotation of said heat roller when predetermined period of time has passed since the rotation was started;

shifting said heat roller from said retracted position to said operable position;

driving said heat roller to rotate when another predetermined period of time has passed since the operation of said image recording apparatus.

* * * * *

UNITED STATES PATENT AND TRADEMARK OFFICE

CERTIFICATE OF CORRECTION

PATENT NO. : 5,170,214

DATED : December 8, 1992

INVENTOR(S) : I. NEGORO et al.

It is certified that error appears in the above-indentified patent and that said Letters Patent is hereby corrected as shown below:

On the cover, in section [57], "ABSTRACT", line 9, change "paticularly" to ---partially---.

At column 8, line 49 (claim 11, line 16), change "disengage" to ---disengaged---.

Signed and Sealed this

Nineteenth Day of November, 1996

Bruce Lehman

*Attest:*

BRUCE LEHMAN

*Attesting Officer*

*Commissioner of Patents and Trademarks*